US007225592B2

(12) United States Patent
Davis

(10) Patent No.: US 7,225,592 B2
(45) Date of Patent: Jun. 5, 2007

(54) SIDING CLIP

(76) Inventor: Scott A. Davis, 7944 Cheney Ridge Rd., Lincoln, NE (US) 68516

( * ) Notice: Subject to any disclaimer, the term of this patent is extended or adjusted under 35 U.S.C. 154(b) by 313 days.

(21) Appl. No.: 10/855,923

(22) Filed: May 27, 2004

(65) Prior Publication Data

US 2005/0262797 A1 Dec. 1, 2005

(51) Int. Cl.
*E04D 1/34* (2006.01)

(52) U.S. Cl. ..... 52/547; 52/714; 52/520; 24/293

(58) Field of Classification Search ..... 52/543, 52/545, 547, 552, 712, 714, 506.05, 546, 52/520; 403/14, 13; 24/293, 297
See application file for complete search history.

(56) References Cited

U.S. PATENT DOCUMENTS 5,392,579 A * 2/1995 Champagne ..... 52/520
5,606,835 A * 3/1997 Champagne ..... 52/545
5,966,875 A * 10/1999 Kuhns ..... 52/12
6,301,856 B1 * 10/2001 Nasi ..... 52/712
6,830,405 B2 * 12/2004 Watanabe ..... 403/14
2002/0032999 A1 * 3/2002 Ito ..... 52/474
2003/0093969 A1 * 5/2003 Saldana ..... 52/715

* cited by examiner

*Primary Examiner*—Lanna Mai
*Assistant Examiner*—Christine T. Cajilig
(74) *Attorney, Agent, or Firm*—Adam H. Jacobs

(57) ABSTRACT

An improved siding clip includes a planar sheet having a lower fold section having a lower end and an upper generally triangular securement section including at least one fastener hole formed therein. The lower fold section includes a generally upright upper section generally adjacent the upper triangular securement section, and a siding edge receiving and retaining structure is mounted on the upper section of the lower fold section which includes a generally L-shaped wall extending rearwards and downwards from the upper section and a plate spring mounted adjacent the generally L-shaped wall operative to bias the siding clip upwards relative to the siding section held within the generally L-shaped wall to frictionally secure the siding clip on the siding section. The lower fold section is bent forwardly, then downwardly and then rearwardly to form a general "C"-shape channel operative to receive and retain a siding portion therein.

11 Claims, 3 Drawing Sheets

SIDING CLIP

BACKGROUND OF THE INVENTION

1. Technical Field

The present invention relates generally to the attachment of vinyl siding to a building, and more particularly to an improved siding clip for mounting siding which includes a planar sheet having a lower fold section having a lower end and an upper generally triangular securement section including at least one fastener hole formed therein. The lower fold section includes a generally upright upper section generally adjacent the upper triangular securement section, and a siding edge receiving and retaining structure is mounted on the upper section of the lower fold section which includes a generally L-shaped wall extending rearwards and downwards from the upper section and a plate spring mounted adjacent the generally L-shaped wall operative to bias the siding clip upwards relative to the siding section held within the generally L-shaped wall to frictionally secure the siding clip on the siding section. The lower fold section is bent forwardly, then downwardly and then rearwardly to form a general "C"-shape opening operative to receive and retain a siding portion therein.

2. Description of the Prior Art

Various types of siding have been used for many years in the construction of homes and other buildings, particularly for years when the outer wall of the building require additional protection from elemental forces such as rain, wind, snow, etc. The three types most commonly used are wood siding, metal siding and plastic or vinyl siding. Each type of siding has various advantages and disadvantages, however, metal and vinyl siding types have become more popular due to their longevity and minimal care needs.

Metal siding is typically formed of aluminum or steel, while plastic siding is conventionally formed from PVC or polyvinyl chloride. Generally, in both types of siding the bottom margin of each panel is bent inwardly in an upwardly deforming longitudinal channel flange with an upstanding inner leg and the top portion of each panel is formed to provide an outwardly and downwardly projecting longitudinal lip corresponding to the channel flange of the adjacent panel. The panels would be secured to the wall along the top portions above the projecting longitudinal lip, such securement commonly being performed by extending nails through the siding into the building wall.

Various types of siding clips have been proposed in the prior art, including such devices as Marcum, Jr., U.S. Pat. No. 4,186,538, Fritz, U.S. Pat. No. 4,327,528 and Wood, U.S. Pat. No. 5,150,555. While each of these clips perform their intended function with some degree of efficiency, there are deficiencies with the use of each of the various clips which are not addressed. For example, a common complaint from siding installers is that most, if not all, of the clips presently available in the prior art require the clip to be installed on the siding prior to the installation of the siding, as is shown in the Wood Patent. During the installation process it is almost inevitable that too few or too many clips would be installed on a particular piece of siding, necessitating removal or installation of an additional clip to conclude the installation process. With those clips found in the prior art, the entire length of siding would need to be removed from the building wall, the offending clip either removed or installed and then the entire section of siding replaced on the building wall. There is therefore a need a for a siding clip which may be quickly and easily installed or removed from a section of siding already being installed on the building wall.

Another problem that is common with both metal and vinyl siding is that as the outside temperature changes, the siding section will expand or contract in accordance with the materials thermal expansion coefficient. Because of this expansion and contraction, most types of siding include nail slots instead of mere nail holes, the nail slots extending longitudinally so that a nail may be driven into the building wall to support the siding yet allow the siding to expand and contract thus permitting the slot to slide around the nail. Of course, one of the difficulties with such nail slots is that in driving the nail into the building wall, care must be taken to not drive the nail too deeply into the wall to prevent movement of the siding due to frictional interference by the nail, which is a commonly occurring problem when nail guns or the like are used to apply the siding. Therefore, there is a need for a siding clip which will permit thermal expansion and contraction of the siding.

Finally, a problem with the prior art clips is many of the more useful and popular clips rely on the semi-rigid construction material to provide the frictional contact which secures the clip on the siding section. However, as the clip ages, the strain on the material does not lessen and the metal or plastic construction material fatigues which can accidentally release the siding section from the clip. There is therefore a need for a siding clip which includes an additional securement device for securely mounting the clip to the siding without requiring additional holes or fasteners.

Therefore, an object of the present invention is to provide an improved siding clip.

Another object of the present invention is to provide an improved siding clip which includes a lower bend section including a generally "C"-shaped convex bend operative to engage and secure the siding within the clip.

Another object of the present invention is to provide an improved siding clip which includes a siding edge receiving and retaining structure which is mounted on the upper section of the lower fold section and which includes a generally L-shaped wall extending rearwards and downwards from the upper section and a plate spring or the like mounted adjacent the generally L-shaped wall operative to bias the siding clip upwards relative to the siding section held within the generally L-shaped wall to frictionally secure the siding clip on the siding section.

Another object of the present invention is to provide an improved siding clip which is quickly and easily installed or removed from siding already being installed on the building wall.

Another object of the present invention is to provide an improved siding clip which will permit thermal expansion and contraction of the siding.

Finally, an object of the present invention is to provide an improved siding clip which is relatively simple and inexpensive in construction and safe and efficient in use.

SUMMARY OF THE INVENTION

The present invention provides a siding clip including a generally planar sheet having a generally rectangular lower fold section having a lower end and an upper generally triangular securement section including at least one fastener hole formed therein. The lower fold section includes a generally upright upper section generally adjacent the upper triangular securement section, and a siding edge receiving and retaining structure is mounted on the upper section of the lower fold section, the siding edge receiving and retaining structure including a generally L-shaped wall extending rearwards and downwards from the upper section and a plate spring or the like mounted adjacent the generally L-shaped wall between the generally L-shaped wall and the upper section of the lower fold section, the plate spring operative to bias the siding clip upwards relative to the siding edge and section held within the generally L-shaped wall to frictionally secure the siding clip on the siding section. The lower fold section is bent forwardly forming a forward bend below the upper section thereof, and the lower fold section is then bent downwardly intermediate the forward bend and the lower end to extend generally parallel with the upper section of the lower fold section. Finally, the lower fold section is bent rearwardly intermediate the downward bend and the lower end whereby the forward, downward and rearward bends form a general "C"-shape opening operative to receive and retain a siding portion therein.

The present invention provides a substantial improvement over the prior art. For example, as the lower fold section of the siding clip secures the siding within the C-shaped bend section, the siding clip may be quickly and easily installed or removed from a siding section by merely sliding the siding clip downwards from the top of the siding section, the siding clip then "popping" into place with the siding section secured within the C-shaped bend section. Also, because the top edge of the siding section fits within the siding edge receiving and retaining structure and the spring bias the clip upwards relative to the siding section, the siding is additionally secured within and by the siding clip. Furthermore, because the siding section is also supported by the generally C-shaped bent section of the clip, thermal expansion and contraction of the siding section will not affect the securement characteristics of the siding clip and the siding is therefore free to slidably move within the clip. Finally, the relatively simple design of the present invention permits easy and efficient use of the siding clip as compared with other devices found in the prior art. It is therefore seen that the present invention provides a substantial improvement over those devices found in the prior art.

DESCRIPTION OF THE PREFERRED EMBODIMENT

Figure 1:
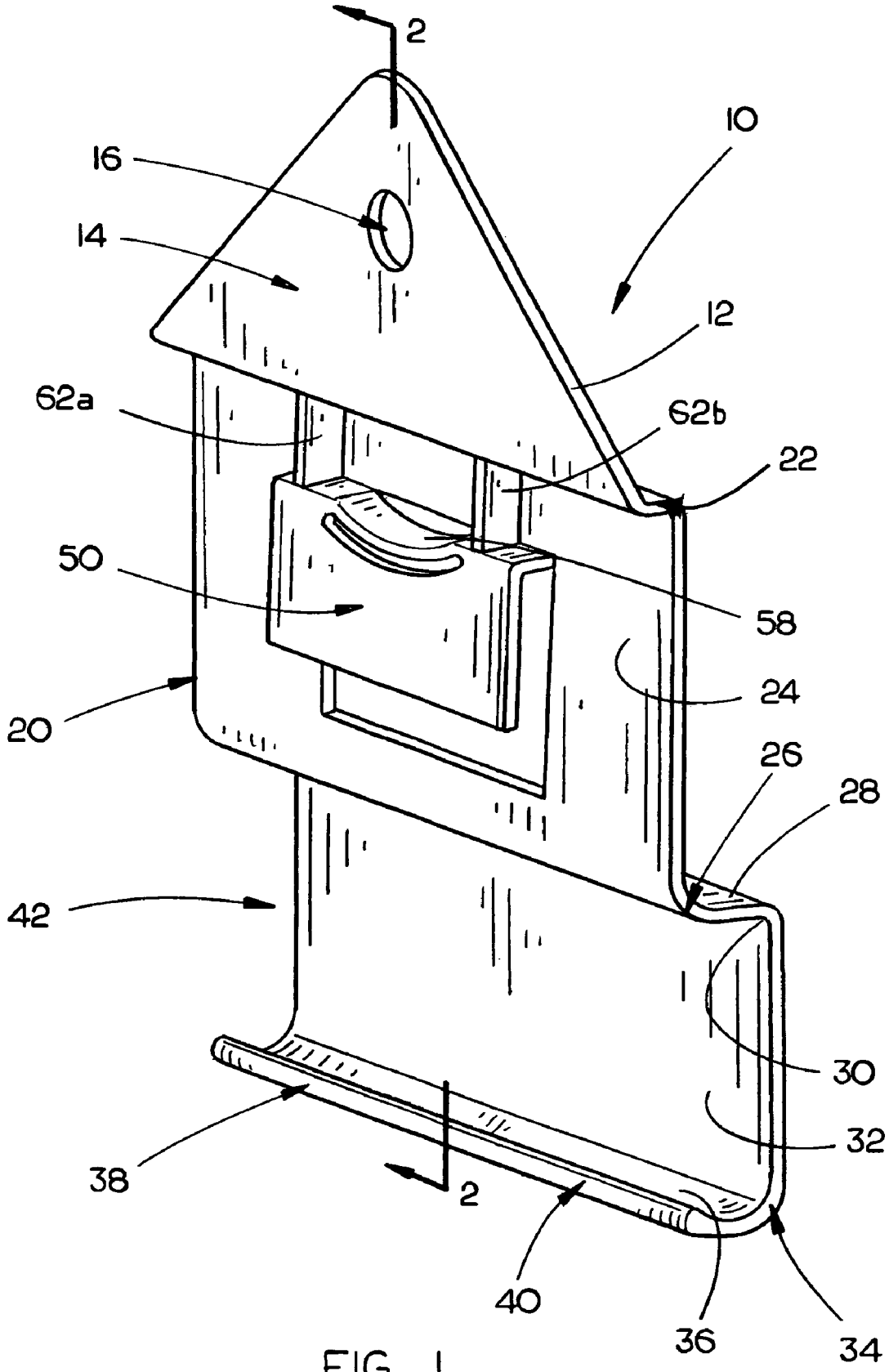
FIG. 1 is a perspective view of the siding clip of the present invention.
Figure 2:
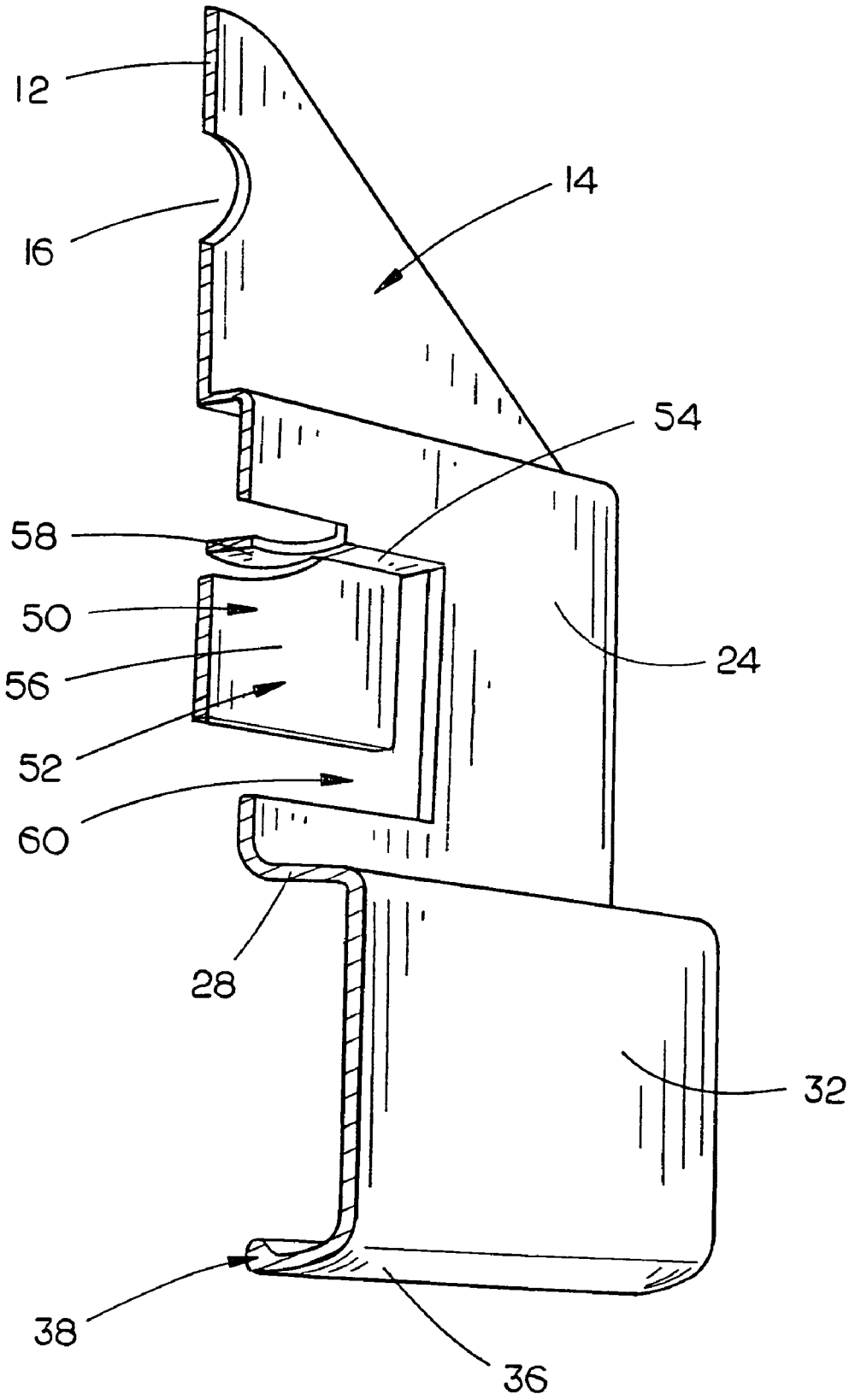
FIG. 2 is a sectional perspective view of the siding clip of the present invention showing the cross-sectional shape of the clip.

The siding clip 10 of the present invention is shown best in FIGS. 1 and 2 as being initially constructed of a single metal or plastic sheet having a width of approximately two to four inches, a height of approximately three to six inches, and a wall thickness of approximately 0.02 to 0.05 inches. The generally planar sheet 12 includes two major sections, the first being an upper generally triangular securement section 14 and the second being a lower fold section 20 which is operative to mount the siding clip 10 on the siding section 80 to which the siding clip 10 is to be mounted. It should be noted, however, that the description of the planar sheet 12 as including the upper securement section 14 and lower fold section 20 is done for convenience of the description of the preferred embodiment and should not be understood to represent specific structural elements or restrictions for the siding clip 10 of the present invention. Also, it is expected that construction of the siding clip 10 out of metal will be via bending and construction of the siding clip 10 out of plastic will likely be via molding or the like, although the particular construction method used in connection with the present invention is not critical so long as the functional features of the present invention are maintained.

The upper securement section 14 would preferably include at least one nail or screw mounting hole 16 which extends perpendicularly through upper securement section 14 generally adjacent the mid-point thereof, as shown best in FIGS. 1 and 2. It should also be noted that, although the upper securement section 14 is described as being generally triangular in shape, it is not necessary for the functionality of the present invention that the upper securement section 14 be such a triangular shape, and in fact may be rectangular, semi-circular, or have several other shapes, depending upon the desires of the manufacturer. It has been found, however, that the triangular shape of upper securement section 14 generally reduces the amount of construction material needed for construction of the upper securement section 14, generally eliminates sharp corners, and further allows the formation mold required when the present invention is constructed of plastic to fit into a smaller press, thus resulting in even greater savings during the production of the siding clip 10 of the present invention. The important functional features of the upper securement section 14 may be satisfied regardless of the specific shape of the upper securement section 14 so long as at least one nail securement hole 16 is available for insertion of a nail or screw therein to secure the upper securement section 14 to the side wall of the building on which the siding clip 10 of the present invention is being mounted. Therefore, modifications to the shape of the upper securement section 14 are understood to be a part of the disclosure of the present invention and are made part of the scope of this invention.

In the preferred embodiment, as shown best in FIG. 1, upper securement section 14 is connected to lower fold section 20 via an offset bend portion 22 such that the upper securement section 14 and upper section 24 of lower fold section 20 extend generally parallel with one another in two generally upright planes. In the preferred embodiment, the upper section 24 of lower fold section 20 extends approximately half the vertical height of lower fold section 20. Upper section 24 ends at the lower part thereof in a forward bend 26 which forms intermediate bend section 28 extending forwards from upper section 24 generally perpendicular thereto. The lower fold section 20 then is bent downwards at the forward end of intermediate bend section 28 forming a downwards bend 30, thus forming the lower section 32 of lower fold section 20.

In the preferred embodiment, lower section 32 of lower fold section 20 has a vertical height approximately equal to the height of upper section 24, although the exact height of lower section 32 will actually be determined by the specific dimensions of the siding section 80 onto which the siding clip 10 is to be fitted. It is further preferred that lower section 32 extend generally parallel with upper section 24 in generally parallel upright planes separated by the width of intermediate bend section 28.

Formed adjacent the base of lower section 32 is rearward bend 34 which connects lowermost bend section 36 with lower section 32 of lower fold section 20. In the preferred embodiment, lowermost bend section 36 would extend generally parallel with intermediate bend section 28 and generally perpendicular to lower section 32 such that the intermediate bend section 28, lower section 32, and lowermost bend section 36 cooperate to form a generally C-shaped channel 42 into which a portion of the siding section 80 may fit and be releasably and frictionally secured therein. One additional important feature of lowermost bend section 36 is the thickened rear lip 38 formed on the rearmost edge 40 of lowermost bend section 36, as shown best in FIGS. 1 and 2. The inclusion of this rear lip 38 provides important structural advantages for the siding clip 10 of the present invention as will be made clear in the following description of the use and installation of the siding clip 10 on a siding section 80, as shown best in FIGS. 3*a* and 3*b*. Also, lowermost bend section 36 may be curved in a partially cylindrical construction to provide enhanced securement of said siding section 80, although such a modification is not necessary to permit the present invention to function effectively.

The preceding description of the lower fold section 20 and upper securement section 14 illustrates many of the specific features of the siding clip 10 of the present invention. However, one significant feature has not been described, although its inclusion in the present invention provides a significant improvement over those clip devices found in the prior art. Specifically, upper section 24 of lower fold section 20 further includes a siding edge receiving and retaining structure 50, the siding edge receiving and retaining structure 50 including a generally L-shaped wall 52 extending rearwards and downwards from the upper section 24 and being positioned at approximately the center of upper section 24, as shown best in FIGS. 1 and 2. Generally L-shaped wall 52 would include a rearwardly-extending generally horizontal wall section 54 and a generally upright wall section 56 extending downwards from the generally horizontal wall section 54 to form the generally L-shaped wall 52 of the siding edge receiving and retaining structure 50. Although the present invention is shown in FIGS. 1 and 2 as further including an upper section wall opening 60 which is generally rectangular in shape, it should be noted that this upper section wall opening 60 need not be included in the present invention to permit proper functioning of the siding clip 10 of the present invention. Inclusion of the upper section wall opening 60 is preferred, however, due to the savings in weight and in construction materials used when the siding clip 10 of the present invention is produced from a molded plastic material.

A very important feature of the siding edge receiving and retaining structure 50 is mounted on the generally horizontal wall section 54 of generally L-shaped wall 52 and consists of a bowed plate spring 58 which extends in a concave orientation relative to generally horizontal wall section 54 in the area between generally L-shaped wall 52 and upper section 24 of lower fold section 20. The bowed plate spring 58 provides additional securement for the siding section 80 on which the clip 10 is mounted as will be described later in this disclosure. Finally, it may be important to include reinforcement struts 62*a* and 62*b* which extend between the offset bend portion 22 between lower fold section 20 and upper securement section 14 and generally horizontal wall section 54 of generally L-shaped wall 52, as shown best in FIGS. 1 and 2. It has been found that these reinforcement struts 62*a* and 62*b* significantly increase the structural strength of the siding clip 10 while not significantly adding to the weight or amount of construction materials needed to create the siding clip 10. It should also be noted that further structural reinforcement devices may be incorporated into the siding clip 10 of the present invention so long as the intended functionality of the siding clip 10 when placed on a siding section 80 is maintained.

Figure 3A:
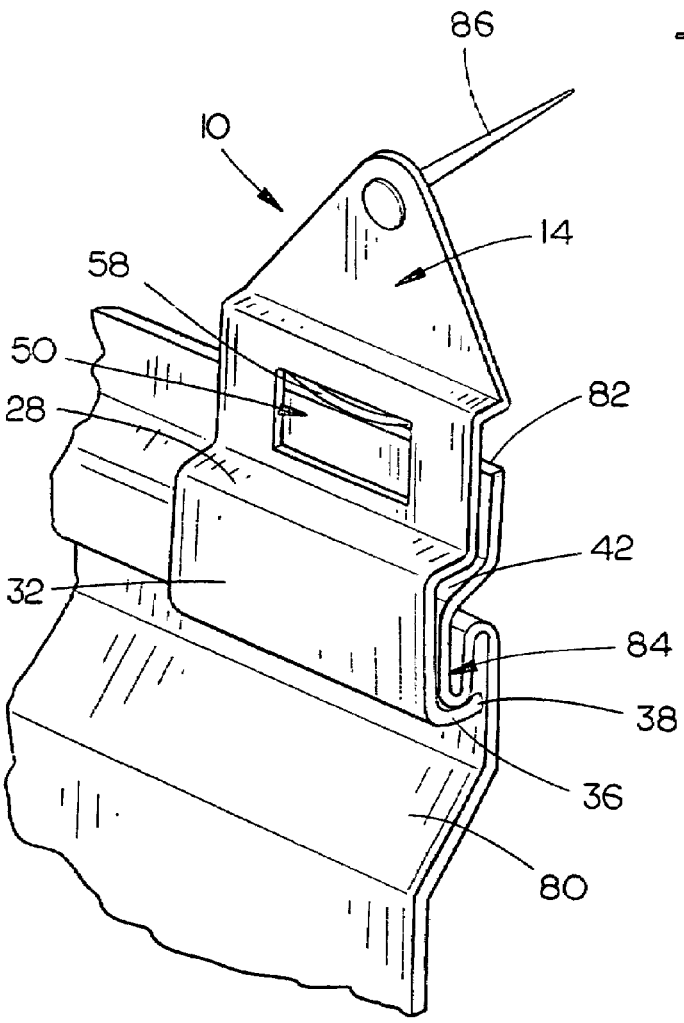
FIGS. 3*a* and 3*b* are each side sectional elevational views showing the siding clip being used to mount siding sections on a building wall.
Figure 3B:
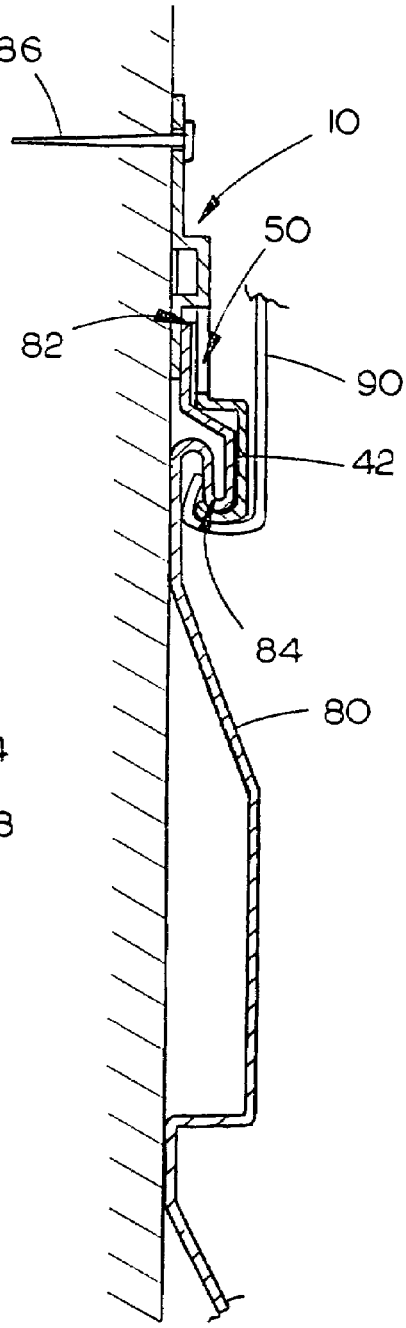

The siding clip 10 of the present invention would be installed on a siding section 80, as shown in FIGS. 3*a* and 3*b*, by either sliding the siding clip 10 onto the siding section 80 from the side thereof or by biasing the siding clip 10 onto the siding section by inserting the top edge 82 of the siding section into the siding edge receiving and retaining structure 50 and pulling the siding clip downwards until the lower fold section 20 of the siding clip 10 extends over the siding section 80 in the appropriate fashion. The siding clip 10 is intended to engage the siding section 80 with the top edge 82 of the siding section 80 fitting into the siding edge receiving and retaining structure 50 specifically within generally L-shaped wall 52. When positioned correctly on the siding section 80, the lowermost bend section 36 fits beneath the bent portion 84 of the siding section 80, as shown in FIG. 3*a*, with the rear lip 38 fitting slightly upwards into the gap between the bent portion 84 of the siding section 80 and the remaining portion of the siding section 80. The bent portion 84 thus fits within the generally C-shaped channel 42 formed by intermediate bend section 28, lower section 32 of lower fold section 20 and lowermost bend section 36. An important feature of the siding clip 10 of the present invention is that the vertical distance between the lowermost bend section 36 and generally horizontal wall section 54 of generally L-shaped wall 52 is approximately equal to the vertical height of siding section 80, as measured from top edge 82 to the lowermost portion of bent portion 84. This means that when the top edge 82 of siding section 80 is held within generally L-shaped wall 52 and the lowermost bend section 36 of lower fold section 20 engages the bent portion 84 of siding section 80, the bowed plate spring 58 is biased upwards because of the concave structure of bowed plate spring 58 when in unbiased position which extends below the generally horizontal wall section 54 of generally L-shaped wall 52. This upwards forcing of the bowed plate spring 58 creates an equal downward force due to the biasing of bowed plate spring 58 downwards which results in additional frictional securement contact of lowermost bend section 36 and rear lip 38 with bent portion 84 of siding section 80. This combination thus provides additional securement for the siding clip 10 on the siding section 80.

Once the siding clip 10 is placed on the siding section 80, the clip 10 is secured to the wall surface by a nail 86 which extends through nail securement hole 16 of upper securement section 14, thus permitting siding clip 10 to support the siding section 80 on the wall surface. The next section of siding 90 would then be locked underneath the siding clip 10 and bent portion 84 of the initially secured siding section 80, as shown in FIG. 3*b*, and the process continues as more siding sections are added to the wall structure.

It is to be understood that numerous additions, modifications, and substitutions may be made to the present invention which fall within the intended broad scope of the appended claims. For example, the construction material used for the siding clip 10, although described as a metal or plastic material, may be of virtually any type of weather-resistant material which is generally rigid and which has the appropriate performance characteristics. Additionally, the exact size and shape of the siding clip 10 of the present invention may be modified or changed to provide any particular desired appearance so long as the specific functional characteristics of the invention are maintained. Furthermore, although the present invention has been described as including a bowed plate spring 58 used in connection with siding edge receiving and retaining structure 50, virtually any type of appropriate biasing device such as a coil spring or other such biasing device may be substituted for the bowed plate spring 58 without significantly modifying the functional characteristics of the present invention. Finally, the siding clip 10 of the present invention may be used with many different types of siding which are commercially available with only minor modifications required thereto, the modifications necessary for such use being understood to fall within the scope of the appended claims.

There has therefore been shown and described a siding clip 10 which accomplishes at least all of its intended objectives.

I claim:

1. A siding clip comprising:

a generally planar sheet having a) a generally rectangular lower fold section having a lower end and b) an upper securement section including at least one fastener hole formed therein;

said lower fold section including a generally upright upper section generally adjacent said upper securement section;

a siding edge receiving and retaining structure mounted on said upper section of said lower fold section, said siding edge receiving and retaining structure including a generally L-shaped wall extending rearwards and downwards from said upper section and biasing means mounted adjacent said generally L-shaped wall between said generally L-shaped wall and said upper section of said lower fold section, said biasing means being a bowed plate spring extending in a concave downwards orientation relative to the rearwardly extending portion of said generally L-shaped wall section, said biasing means operative to bias said siding clip upwards relative to the siding edge and section held within said generally L-shaped wall to frictionally secure said siding clip on a siding section;

said lower fold section being bent forwardly forming a forward bend below said upper section thereof;

said generally L-shaped wall extending downwards with the lowest edge of said generally L-shaped wall positioned above said forward bend of said lower fold section;

said lower fold section being bent downwardly intermediate said forward bend and said lower end to extend generally parallel with said upper section of said lower fold section; and said lower fold section being bent rearwardly intermediate said downward bend and said lower end whereby said forward, downward and rearward bends form a general "C"-shape channel operative to receive and retain siding therein.

2. The siding clip of claim 1 wherein said upper securement section of said generally planar sheet is generally triangular in shape.

3. The siding clip of claim 1 wherein said generally planar sheet is constructed of metal.

4. The siding clip of claim 1 wherein said generally planar sheet is constructed of plastic.

5. The siding clip of claim 1 wherein said lower fold section further comprises a lowermost bend section below said rearward bend and a thickened rear lip formed on a rearmost edge of said lowermost bend section, said thickened rear lip extending upwards above the adjacent part of said lowermost bend section and being operative to provide additional frictional securement of said siding clip on a siding section due to the engagement of said thickened rear lip with a surface of a siding section.

6. The siding clip of claim 5 wherein said lowermost bend section is curved in a partially cylindrical construction to provide enhanced securement of a siding section.

7. A siding clip comprising:

a generally planar sheet having a) a generally rectangular lower fold section having a lower end and b) a generally triangular upper securement section including at least one fastener hole formed therein;

said lower fold section including a generally upright upper section generally adjacent said upper securement section;

a siding edge receiving and retaining structure mounted on said upper section of said lower fold section including a biasing means, said biasing means being a bowed plate spring extending in a concave downwards orientation, said biasing means operative to engage an upper section of a siding section and bias said siding clip upwards relative to the siding edge and section engaged by said biasing means to frictionally secure said siding clip on a siding section;

said lower fold section being bent forwardly forming a forward bend below said upper section thereof said lower fold section being bent downwardly intermediate said forward bend and said lower end to extend generally parallel with said upper section of said lower fold section;

said lower fold section being bent rearwardly intermediate said downward bend and said lower end whereby said forward, downward and rearward bends form a general "C"-shape channel operative to receive and retain siding therein; and said lower fold section further including a lowermost bend section below said rearward bend and a thickened rear lip formed on a rearmost edge of said lowermost bend section, said thickened rear lip extending upwards above the adjacent part of said lowermost bend section and being operative to provide additional frictional securement of said siding clip on a siding section due to the engagement of said thickened rear lip with a surface of a siding section.

8. The siding clip of claim 7 wherein said generally planar sheet is constructed of metal.

9. The siding clip of claim 7 wherein said generally planar sheet is constructed of plastic.

10. The siding clip of claim 7 wherein said lowermost bend section is curved in a partially cylindrical construction to provide enhanced securement of a siding section.

11. In combination:

a siding section including a generally planar main body and further having a top edge and a forwardly-extended bent portion generally adjacent said top edge of said siding section thereby forming a gap between said bent portion and the remaining portion of said siding section; and a siding clip including:

a generally planar sheet having a) a generally rectangular lower fold section having a lower end and b) an upper securement section including at least one fastener hole formed therein;

said lower fold section including a generally upright upper section generally adjacent said upper securement section;

a siding edge receiving and retaining structure mounted on said upper section of said lower fold section, said siding edge receiving and retaining structure including a generally L-shaped wall extending rearwards and downwards from said upper section and biasing means mounted adjacent said generally L-shaped wall between said generally L-shaped wall and said upper section of said lower fold section;

said lower fold section being bent forwardly forming a forward bend below said upper section thereof;

said lower fold section being bent downwardly intermediate said forward bend and said lower end to extend generally parallel with said upper section of said lower fold section;

said lower fold section being bent rearwardly intermediate said downward bend and said lower end whereby said forward, downward and rearward bends form a general "C"-shape channel operative to receive and retain siding therein;

said top edge of said siding section fitting into said siding edge receiving and retaining structure; said bent portion of said siding section fitting within said generally "C"-shaped channel with said rearward bend fitting into said gap between said bent portion of said siding section and said remaining portion of said siding section; and said biasing means operative to engage said top edge of said siding clip and bias said siding clip upwards relative to said siding section held within said generally L-shaped wall to frictionally secure said siding clip on said siding section.

* * * * *